US006718661B1

(12) United States Patent
Miller

(10) Patent No.: US 6,718,661 B1
(45) Date of Patent: Apr. 13, 2004

(54) BOOM

(76) Inventor: Gerald D. Miller, 1665 W. Old Slocum Trail, LaFontaine, IN (US) 46940

( * ) Notice: Subject to any disclaimer, the term of this patent is extended or adjusted under 35 U.S.C. 154(b) by 0 days.

(21) Appl. No.: 10/198,396

(22) Filed: Jul. 18, 2002

(51) Int. Cl.[7] ..... E02F 3/96
(52) U.S. Cl. ..... 37/403; 37/408; 37/395; 414/724
(58) Field of Search ..... 37/446, 403, 408, 37/409, 410, 466, 452, 347, 395; 414/724

(56) References Cited

U.S. PATENT DOCUMENTS

| | | | | | |
|---|---|---|---|---|---|
| 2,183,867 | A | * | 12/1939 | Johansen | 254/415 |
| 2,698,035 | A | * | 12/1954 | Smith, Jr. | 83/795 |
| 3,092,259 | A | * | 6/1963 | Swanson | 212/177 |
| 3,266,179 | A | | 8/1966 | Golden | |
| 3,587,887 | A | | 6/1971 | DeCarli | |
| 3,605,392 | A | | 9/1971 | Fossum | |
| 3,710,472 | A | * | 1/1973 | Gremillion et al. | 29/891 |
| 3,731,380 | A | * | 5/1973 | Mathiesen | 30/381 |
| 3,812,979 | A | | 5/1974 | Leihgeber | |
| 3,881,615 | A | | 5/1975 | Albright | |
| 3,949,817 | A | * | 4/1976 | Rice | 173/170 |
| 4,159,059 | A | * | 6/1979 | Christenson et al. | 414/724 |
| 4,200,423 | A | | 4/1980 | Sornsin | |
| 4,341,017 | A | * | 7/1982 | Janczak | 30/381 |
| 4,627,227 | A | | 12/1986 | Dixon | |
| 5,161,448 | A | * | 11/1992 | Wangsness | 83/795 |
| 5,430,999 | A | | 7/1995 | Grant | |
| 5,542,326 | A | * | 8/1996 | Borgford | 83/795 |
| 5,787,536 | A | * | 8/1998 | Pate | 7/161 |
| 5,813,151 | A | | 9/1998 | Stephens et al. | |
| 5,957,213 | A | | 9/1999 | Loraas et al. | |
| 6,045,320 | A | | 4/2000 | Cullen | |
| 6,336,565 | B1 | * | 1/2002 | Merkel et al. | 212/168 |

FOREIGN PATENT DOCUMENTS

| | | | |
|---|---|---|---|
| JP | 406007018 | A | 1/1994 |

* cited by examiner

*Primary Examiner*—Thomas B. Will
*Assistant Examiner*—Thomas A. Beach
(74) *Attorney, Agent, or Firm*—Krieg DeVault Lundy LLP

(57) ABSTRACT

A new and improved appliance boom having opposite ends. One of the ends is adapted to be secured to the bucket of an articulated powered bucket loader. The other end is adapted to be secured to an appliance. The boom has means for guiding appliance control cables from end to end. At least one control cable having opposite ends is trained through the means. One of the control cable ends is attached to the appliance; the other of the control cable ends is attached to a control in the cab of the bucket loader to which the boom is attached. The appliance cradle may be secured to appliances ranging from crane pulleys, chain saws, and rotary drills, reciprocating saws, to other rotary or reciprocating equipment. The appliance boom may be secured to the bucket of a conventional bucket loader and unattached conveniently and stored when not in use.

24 Claims, 5 Drawing Sheets

BOOM

BACKGROUND OF THE INVENTION

The present invention relates to a new and improved appliance boom, and more particularly, to a new and improved appliance boom which can be readily attached and detached to a conventional tractor utilized and stored when not in use.

Small building contractors and farmers usually have a variety of tractors or other machinery in their possession. Both farmers and contractors need to accomplish a variety tasks in their chosen occupations. Contractors for example must move heavy equipment or supplies from one location to another or move dirt around as in back filling around building foundations or bulldozing, trenching, or the like. Whereas farmers besides normal planting, herbicide spraying and cultivating operations, often need to do light bulldozing, lay drainage pipes, trim trees or other tasks.

Both farmers and building contractors, generally have a number of tractors, harvesters, bulldozers, and the like around. Neither can afford to have any of these machines idle for long periods of time in the competitive markets in which both contractors and farmers operate. It is therefore highly desirable to provide a new and improved appliance boom which can be quickly attached and detached from conventional machinery to make that machinery more versatile and stored when not in use.

Most small contractors and farmers have in their possession what is commonly known as a bucket loader or a front end loader although bucket loaders can be found both on the front end and the rear end of a variety of tractor types. Bucket loaders are usually considered dirt moving equipment such as bulldozers but are distinguished from bulldozers inasmuch as bucket loaders have a bucket rather than a blade. Thus, the bucket loader is a cross between a bulldozer and a power shovel. The bucket loaders to which we refer have a large open bucket mounted to a tractor body in front or to the rear of a cab on a pair of lifting arms capable of raising the bucket from a position below ground level to an elevated position higher than the cab, and sometimes approximately over the cab. In addition, the bucket is mounted so that it can be tilted forward in order to dig its front edge or cutting edge into a pile of gravel or soil and to dump its load into a dump truck, and backward into a carrying position so that it can be raised to the height of a dump truck, and then tilted again forward from its carrying position to deposit its load into a truck.

Bucket loaders have several applications such as light bulldozing or backfilling, lifting heavy objects from one place to another, and a number of other common tasks around farm and construction sites. The term bucket loader herein will refer to all types of such equipment which have buckets mounted on a pair of lifting arms capable of raising the bucket from a position below ground to an elevated position over the cab and to rotate the bucket from a dumping position in which the bucket opening is facing the ground to a carrying position in which the bucket opening is facing upwardly. It is therefore highly desirable to provide a new and improved appliance boom for bucket loaders to increase their versatility and to give bucket loaders new and improved usefulness.

Bucket loaders, in the past have been modified to mount or carry boom members or cranes for special lifting applications. Such members however, have been cumbersome to utilize. Some require the dismounting of the bucket from the lift arms of the bucket holder so as to mount the boom on the lift arms. Others have required extensive modifications to the bucket loader in order to mount the boom. It is therefore highly desirable to provide a new and improved appliance boom for mounting on a conventional bucket loader which is convenient to use. It is also highly desirable to provide a new and improved appliance boom which can easily be mounted and dismounted from a conventional bucket loader. It is also highly desirable to provide a new and improved appliance boom that can carry a number of useful appliances at its distal end to increase the versatility of a conventional bucket loader.

The versatility of a conventional bucket loader may be widely expanded by converting the bucket loader into a crane by attaching to bucket of the bucket loader an appliance boom having at its distal end a pulley and a cable trained through the pulley to a winch. While it is well known that such an attachment will expand the usefulness of a bucket loader, past attempts to mount or carry boom members or cranes on bucket loaders have been not convenient to use. Crane attachments in the past have required time consuming installation procedures and little or no provision for detaching and storing the crane when it is not in use. Examples of such usage of such prior boom attachments to bucket loaders and other equipment are shown in U.S. Pat. Nos. 3,092,259; 4,200,423; 3,249,245; 3,587,887. Therefore it is highly desirable to provide a new and improved appliance boom for convenient attachment and detachment to a conventional bucket loader and storage of the boom when not in use.

The versatility of bucket loaders may also be greatly expanded. Landscape contractors, for example, and farmers are often concerned about trimming trees in remote and hard to get to places. In the past, most tree trimming along right in ways has been done with trucks with limited off road mobility having a boom which carries at its end a gondola or a cherry picker. The gondola is positioned adjacent to the tree line and a man in the gondola or cherry picker utilizes a chain saw to sever the branches and limbs of the trees along the tree line. This procedure is relatively expensive, time consuming and may be dangerous to the operator of the vehicle as well as to the operator of the chain saw.

Even more dangerous is a practice utilized by farmers where the tree line is off road in rough country where cherry pickers can not travel. Farmers have been known to utilize bucket loaders to trim hedge rows between fields by having one person standing in the bucket of a bucket loader and having another person operate the tractor to position the tractor and to lift the bucket above the tractor cab such that the person in the bucket can trim the trees with a chain saw. The inherent danger to the farmer in the bucket with the chainsaw and/or the likelihood of dropping limbs on the farmer in the tractor is obvious. It is therefore highly desirable to provide a new and improved appliance boom which can be readily attached to the bucket of a bucket loader and utilized to operate a wide range of appliances at the distal end thereof from the ground. It is also highly desirable to provide a new and improved appliance boom which can be readily attached and unattached to the bucket of a bucket loader and operated remotely from the cab of the bucket loader single handedly. It is also highly desirable to provide a new and improved appliance boom which can be readily attached to the bucket of a conventional bucket loader to allow appliances such as chainsaws, reciprocating saws, drills, scissors or shears, any other reciprocating or rotary or pivotal power machinery, and cameras to be operated remotely from the cab single handedly.

Both in the construction industry and farming, equipment cost is a major factor. It is therefore highly desirable to provide a new and improved appliance boom which can be readily attached and unattached from a conventional bucket loader and stored when not in use which gives to the bucket loader new versatility and usefulness in the construction and farming industries which is relatively inexpensive to manufacture and convenient to use. It is also highly desirable to provide a new and improved appliance boom which can be readily attached and unattached from a conventional bucket loader and stored when not in use which gives to the bucket loader new versatility and usefulness in the construction and farming industries which is relatively inexpensive to manufacture and convenient to use.

Other booms attached to vehicles whether they are bucket loaders or other tractor like vehicles have always posed a problem in being transported from one location to another. Larger cranes and shovels are usually transported on flat bed trucks. However, tractors are usually moved from one location to another down roads and over highways. Thus, it is highly desirable to provide a new and improved appliance boom which when attached to a vehicle may be transported from one location to another over the road. State laws require vehicles passing over roads to have dimensions less than certain maximum dimensions. Thus, it is highly desirable to provide a new and improved appliance boom which when attached to a vehicle for traveling over the roads has dimensions which are less than the maximum dimensions prescribed by laws.

It is also highly desirable to provide a new and improved appliance boom which can be attached to conventional bucket loader and which is moveable from an extended condition in which it is useful to a collapsed condition which has dimensions less than those prescribed by law for over the road travel.

Finally it is highly desirable to provide a new and improved appliance boom having all of the features above mentioned.

SUMMARY OF THE INVENTION

It is therefore an object of the invention to provide a new and improved appliance boom which can be quickly attached and detached from conventional machinery to make that machinery more versatile and stored when not in use.

It is also an object of the invention to provide a new and improved appliance boom for bucket loaders to increase their versatility and to give bucket loaders new and improved usefulness.

It is also an object of the invention to provide a new and improved appliance boom for mounting on a conventional bucket loader which is convenient to use.

It is also an object of the invention to provide a new and improved appliance boom which can easily be mounted and dismounted from a conventional bucket loader.

It is also an object of the invention to provide a new and improved appliance boom that can carry a number of useful appliances at its distal end to increase the versatility of a conventional bucket loader.

It is also an object of the invention to provide a new and improved appliance boom for convenient attachment and detachment to a conventional bucket loader and storage of the boom when not in use.

It is also an object of the invention to provide a new and improved appliance boom which can be readily attached to the bucket of a bucket loader and utilized to operate a wide range of appliances at the distal end thereof from the ground.

It is also an object of the invention to provide a new and improved appliance boom which can be readily attached and unattached to the bucket of a bucket loader and operated remotely from the cab of the bucket loader single handedly.

It is also an object of the invention to provide a new and improved appliance boom which can be readily attached to the bucket of a conventional bucket loader to allow appliances such as chainsaws, reciprocating saws, drills, scissors or shears, or any other reciprocating or rotary or pivotal power machinery, and cameras to be operated remotely from the cab single handedly.

It is also an object of the invention to provide a new and improved appliance boom which can be readily attached and unattached from a conventional bucket loader and stored when not in use which gives to the bucket loader new versatility and usefulness in the construction and farming industries which is relatively inexpensive to manufacture and convenient to use.

It is also an object of the invention to provide a new and improved appliance boom which can be readily attached and unattached from a conventional bucket loader and stored when not in use which gives to the bucket loader new versatility and usefulness in the construction and farming industries which is relatively inexpensive to manufacture and convenient to use.

It is also an object of the invention to provide a new and improved appliance boom which when attached to a vehicle may be transported from one location to another over the road.

It is also an object of the invention to provide a new and improved appliance boom which when attached to a vehicle for traveling over the roads has dimensions which are less than the maximum dimensions prescribed by laws.

It is also an object of the invention to provide a new and improved appliance boom which can be attached to conventional bucket loader and which is moveable from an extended condition in which it is useful to a collapsed condition which has dimensions less than those prescribed by law for over the road travel.

It is finally an object of the invention to provide a new and improved appliance boom having all of the features above mentioned.

In the broader aspects there is provided a new and improved appliance boom having opposite ends. One of the ends is adapted to be secured to the bucket of an articulated powered bucket loader. The other end is adapted to be secured to an appliance. The boom has means for guiding appliance control cables from end to end. At least one control cable having opposite ends is trained through the means. One of the control cable ends is attached to the appliance, the other of the control cable ends is attached to a control in the cab of the bucket loader to which the boom is attached. The appliance cradle may be secured to appliances ranging from crane pulleys, chain saws, rotary drills, reciprocating saws, to other rotary or reciprocating appliances. The appliance boom may be secured to the bucket of a conventional bucket loader and unattached conveniently and stored when not in use.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
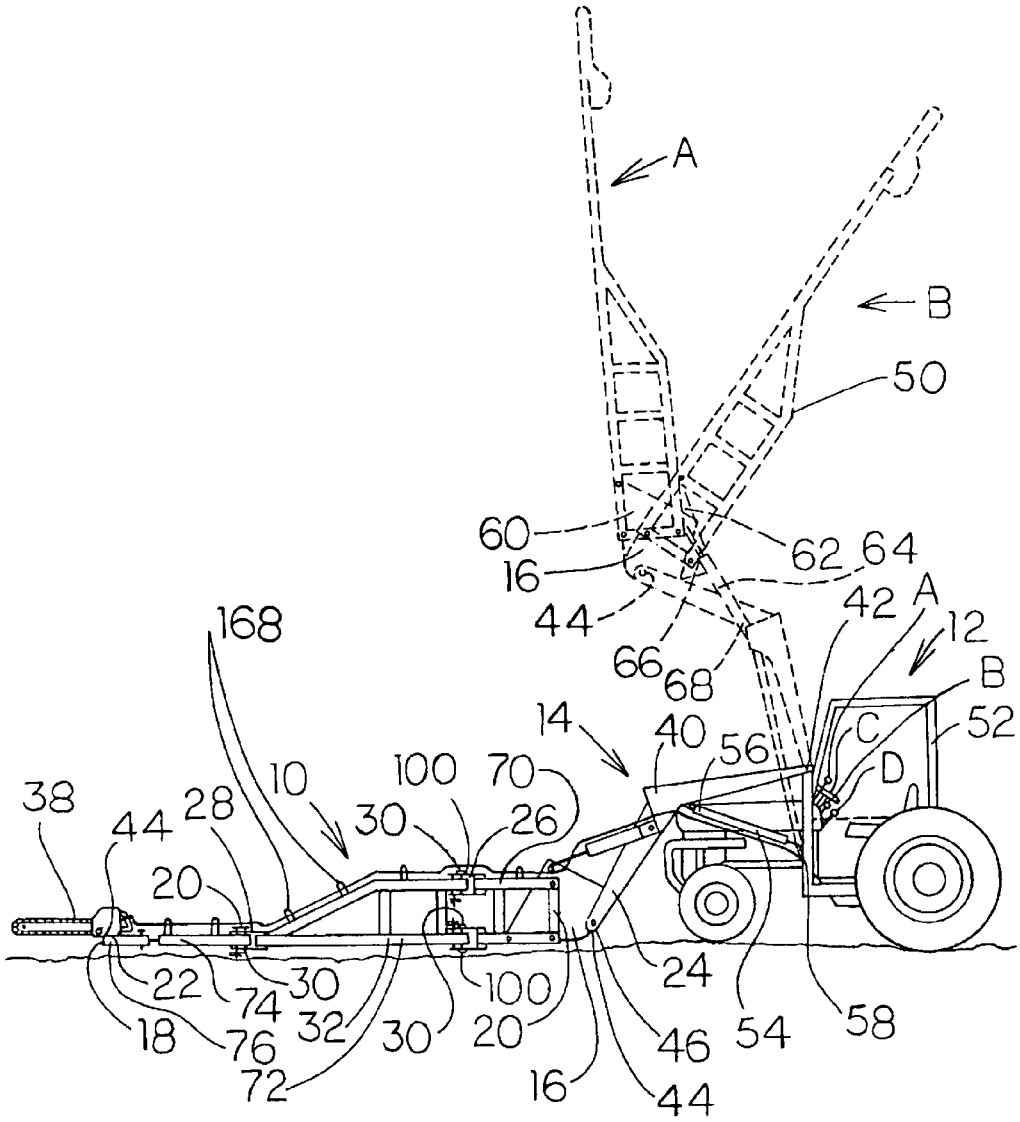
FIG. 1 is a side elevational view of a tractor having a front oriented bucket loader attached to the tractor and the new and improved appliance boom attached to the bucket in its extended position with a chainsaw attached to the appliance cradle of the boom in both a lower position (solid lines) and in two elevated positions A and B (dashed lines)

Shown in FIG. 1, the new and improved appliance boom 10 of the invention attached to a conventional tractor 12 having a bucket loader 14 attached to the front of the tractor. The boom 10 is secured to the bucket 16 of the bucket loader 14 so as to extend outwardly from the tractor 12.

Boom 10 is elongated and has opposite ends 18, 20. At one of the ends 18, boom 10 is secured to an appliance cradle 22. At the other end 20, boom 10 is connected to the powered articulated appliance hitch 24 of the tractor 12. Between at the opposite ends 18, 20 of boom 10, boom 10 is articulated at 26 and 28. At both pivots 26 and 28, adjacent sections of boom 10 may pivot relative to each other about a pivot pin 30 which extends generally vertically so as to fold in front of the bucket 16. Thus, boom 10 is moveable from an extended position 32 shown in FIG. 1 to a folded condition 34 shown in FIG. 4 through several intermediate positions 36 shown in FIG. 2.

Attached to the appliance cradle 22 is an appliance 38. As shown in FIG. 1, appliance 38 may be a gasoline engine powered chainsaw. In specific embodiments appliance 38 can be chainsaws, rotary drills, reciprocating saws, rotary saws, weed whackers, scissors or shears, cameras, or any other rotary or reciprocating or pivotal appliance powered independently of the tractor such as by gasoline engines or electric motors powered from the 12 volt electrical system of the tractor 12 or hydraulic motors powered from the tractor hydraulic system.

The articulated appliance hitch 24 of the tractor 12 includes a pair of arms 40 which are pivotally connected to the tractor 12 at 42 on opposite sides of the tractor 12. Arms 40 extend forwardly of the pivot 42. The arms 40 extend forwardly over the tractor 12 and downwardly of the tractor 12 as shown in FIG. 1. Arms 40 have distal ends 44 between which bucket 16 is pivotally secured at a bushing 46. Bucket 16 may be moved from a position 48 (not shown) in which distal end 44 is below the grade level upon which the tractor 12 is supported to a position 50 shown in dashed lines in which the distal end 44 is essentially over the cab 52 of the tractor 12 by means of a power cylinder 54 pivotally connected between the arms 40 at 56 and the tractor 12 frame at 58. Bucket 16 is moveable from a position 60 in position 48 in which the opening of the bucket 16 faces downwardly to a position 62 in which the opening of the bucket faces upwardly. This movement of the bucket 16 is accomplished by a power cylinder 64 pivotally connected to the bucket 16 at 66 and to arms 40 at 68. Cylinders 54 and 64 are connected to the pressurized hydraulic fluid system of the tractor and are controlled by the control levers C and D in the cabin of the tractor 12.

One aspect of the invention is that the positioning of the distal end 44 of the boom 10 and the movement thereof is totally accomplished by the articulation of the articulated powered appliance hitch 24 of a conventional tractor 12. While the movement of the distal end 44 is exaggerated by the length of the boom 10, the movement is totally accomplished by the articulation of the boom 10 and the actuation of the power cylinders 54, 64 of the articulated power appliance hitch 24 of the tractor 12 as the boom 10 is rigidly secured to the bucket 16 and the appliance 38 is rigidly secured to the appliance cradle 22.

Figure 4:
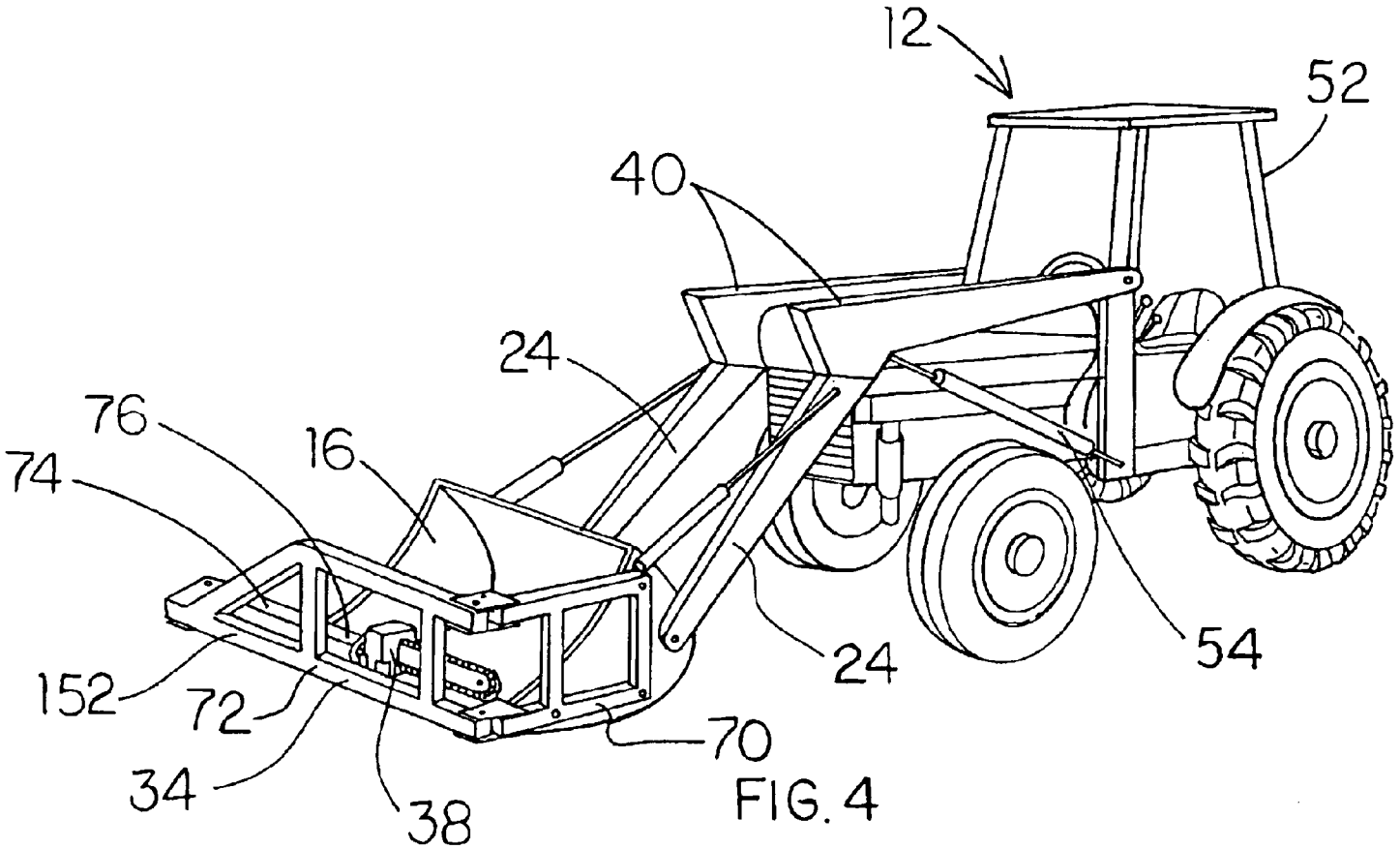
FIG. 4 is a perspective view of the appliance boom in its collapsed position secured to a chainsaw appliance.

Referring to FIGS. 1 and 4, the boom 10 will know be described in detail. Boom 10 comprises four segments 70, 72, 74 and 76. Adjacent end 18 of the first segment 70 is a rectangular frame consisting of two spaced apart vertical members 78 and 80 secured between a top member 82 and a bottom member 84. Members 82, 84 each have opposite ends 86 and 88. Ends 86 define end 18 of boom 10. At end 88 a portion of members 82 and 84 extends from the vertical member 80 outwardly.

End portion 88 of both members 82, 84 are essentially identical and will be described together. Each end portion 88 has a top plate 90 and a bottom plate 92 secured thereto. Each plate 90, 92 is in the form of a parallelogram with two generally parallel sides 102 connected by a third generally perpendicular side 104 at one end thereof and an angular side 105 at the other end thereof. One pair of plates 90, 92 are spaced apart and end 88 of top member 82 is positioned therebetween at short end 102. The plates are welded to end 88 of top member 82. Similarly, another pair of plates 90, 92 are spaced apart and end 88 of bottom member 84 is positioned therebetween at short end 102. Plates 90, 92 are welded to bottom member 84 such that all four plates 90, 92 which are secured to top member 82 and bottom member 84 are aligned so as to define vertically extending planes which in generally horizontal cross-sections define the shape of plates 90, 92.

Figure 2:
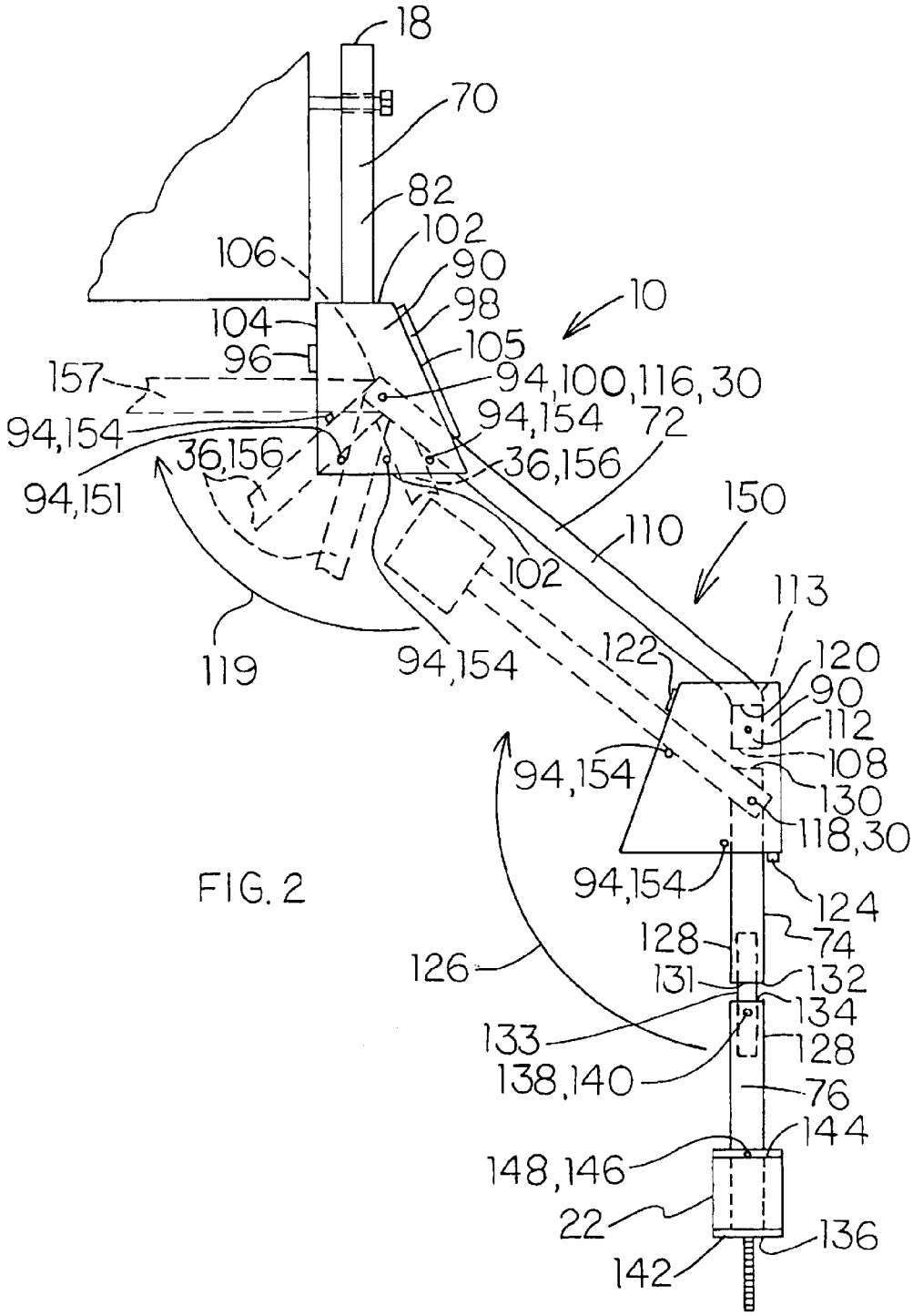
FIG. 2 is a fragmentary top view of the tractor boom and chainsaw illustrated in FIG. 1 in its extended position (solid lines) and in its other positions (dashed lines)

As shown in FIG. 2, each of the plates have five holes 94 drilled therein on the same vertical axis. Secured to both pairs of plates 90, 92 secured to members 82, 84 is a plate 96 and a plate 98 which act not only to maintain the spacing of the plates 90, 92, but also act as stops for the segment 72 of boom 10 as will be described hereinafter. A bolt 100 is positioned in the most centrally located hole 94 and extends through each pair of plates 90, 92. Segment 72 is positioned on bolt 100 to be pivotally connected to segment 70.

Adjacent end 18 of the segment 70, top and bottom members 82 and 84 both have mounting holes 102 therein. Member 84 has a spaced apart additional mounting hole 104. Similarly, the bucket 16 at the side to which the boom 10 is to be mounted has holes 160 drilled therein to correspond in both spacing and size to holes 102 and 104 and to receive bolts 162 therethrough whereby the boom 10 may be secured to bucket 16.

Segment 72 has opposite ends 106 and 108. Segment 72 has top and bottom members 110 and 112 separated by two vertical members 114. Both top 110 and bottom 112 members extend beyond the most adjacent vertical member 114 to define end 106. Both the size and the spacing of members 110, 112 allow the members to fit between plates 90, 92 of end 88 of segment 70. Both members 110, 112 have an opening 116 therein adjacent end 106 in which bolts 100 are positioned. Bolts 100 also pass through hole 94 in plates 90, 92 so as to pivotally connect segment 72 with segment 70 at end 106.

Adjacent end 108 top member 110 slopes toward member 112. End 120 of member 110 is secured to member 112 adjacent end 108. Between end 108 and member 110, a third pair of plates 90, 92 are positioned on the top and bottom of member 112 and secured thereto. End 108 extends like end 88 from the shorter of side 102 of plates 90, 92 and is secured to plates 90, 92. Plates 90, 92 extend from end 108 of segment 70. All of the plates 90, 92 are essentially the same in size and shape and only differ in the positioning of holes 94 therein. Plates 90, 92 secured to end 108 of segment 72 are further secured in spaced apart position by plates 122 and 124 which extend between plate 90 to 92 and secured thereto. Member 112 is bent at 113 adjacent to end 108 in order to allow segment 74 to rotate into a position in which segments 72 and 74 will be essentially parallel to each other and adjacent plate 122 as indicated by the arrow 126 in FIG. 2. Plates 122 and 124 function as stops for the rotation of segment 74 relative to segment 72 as will be explained hereinafter.

Segment 74 has opposite ends 130 and 131. Adjacent end 130 is an opening 132 in which a bolt 118 is positioned and about which segment 74 pivots. Bolt 118 is placed in an opening 94 in plates 90, 92 secured to element 72 adjacent end 108 such that segment 74 may pivot relative to segment 72 as indicated by the arrow 126 in FIG. 2. Adjacent the other end 131 of segment 74 is a receptacle 128 in which a steel rod 133 is positioned and secured to segment 74.

Segment 76 has opposite ends 134, 136. Adjacent end 134 is a receptacle 128 in which a steel rod 133 may be position ed. A bore 138 extends through both receptacle 128 of segment 76 and rod 133. A pin 140 is positioned in bore 138 to removably secure segment 76 to segment 74.

Adjacent end 136 is the appliance cradle 22. In the specific embodiment illustrated appliance cradle 22 comprises a fixed bracket 142 secured at end 136 of segment 76 and a moveable bracket 144 secured remotely from end 136 to segment 76. The appliance to be secured to end 136 of segment 76 of boom 10 is mounted to segment 76 by sliding the front portion of the appliance under the fixed mounting bracket 142 and moving the moveable mounting bracket 144 to engage the appliance and securing the same in position to segment 76 by means of a bolt 146 which passes through a slot 148 in segment 76.

In this version, when pin 140 is removed from bore 138 the appliance can be removed from the boom 10 for repair, fueling or the like by sliding rod 130 from receptacle 128 and readily reattached thereto for use by replacing rod 130 in receptacle 128 and replacing pin 140 in bore 138.

Referring to FIGS. 2 and 4, boom 10 constructed as above described in its extended position 32 can be folded in front of the bucket 16 into a collapsed position 34 for transportation over the road. As shown in FIG. 2, in dashed lines, segments 74 and 76 can be rotated about bolt 118 as suggested by arrow 126 from adjacent stop plate 124 to adjacent stop plate 122 to position segments 74 and 76 generally parallel to segment 72 as shown in dashed lines. Plates 90, 92 secured to segment 72 adjacent end 108 has openings 94 therein in which a pin 154 may be positioned to lock element 74 either in the extended position 32 or the collapsed position 34 shown in FIG. 2. Similarly, element 72 can be rotated about bolt 100 from adjacent plate 98 to adjacent plate 96 from an extended position 32 to a collapsed position 34 in which segment 72 extends generally perpendicularly to segment 70 as shown in FIG. 2. A pin 154 may be positioned in holes 94 within plates 90, 92 secured to segment 70 to lock element 72 either in its extended position 32 or in its collapsed position 34 or in three intermediate positions 156 as desired as suggested in FIG. 2 by arrow 119. FIG. 4 illustrates boom 10 in its fully collapsed position in front of bucket 16. The five positions 32, 34, or 156 allow the boom to be fully extended from the tractor 12 or positioned as desired therebetween such that the appliance may be always visibly seen by the operator of the tractor during use or inserted into positions of difficult access, as needed.

In the specific embodiment illustrated, the boom 10 is secured to the left hand side 158 of bucket 16 by drilling holes 160 in the bucket 16. These holes 160 are spaced apart and sized to correspond with holes 102, 104 in members 82, 84 of segment 70. Bolts 162 extend through the bucket holes 160 and the boom holes 102, 104 to rigidly secure the boom 10 to the bucket 16. As illustrated in the drawings, the boom 10 extends from the left side of the bucket 16 to the left of the tractor 12 and outwardly therefrom. In another specific embodiment, the boom 10 could be secured to the right side of the bucket 16, in which case the top planar view would appear as the mirror image of the top planar view shown in FIG. 2 as drawn with segments 72 and 74 and 76 pivotally connected thereto in the same manner allowing segments 72, 74, 76 to fold in front of the bucket 16 and to function similarly to that above described.

In a specific embodiment, each of the members 82, 84 78, 80, 110, 112, 114, and 116 are of tubular steel welded together as above described. Each of the plates 90, 92, 96, 98, 124, 122 are cut to the size and shape required from half inch steel plate. Bolts 100, 118 are ⅝ inch threaded bolts with ⅝ inch lock nuts thereon. All of the pins 154 are ½ inch headed pins with cotter pins adjacent the distal end.

In the specific embodiment shown in FIGS. 1–4, the boom 10 is secured to the left side of the bucket 16 and extends outwardly to the left and forwardly thereof. In another specific embodiment, the boom 10 can be secured to the right side of the bucket so as to extend outwardly to the right and forwardly thereof. The boom, in a top elevational view such as FIG. 2, secured to the left side of the bucket and to the right side of the bucket will appear as mirror images. In both embodiments, boom 10 can be moved from its extended position 32 into its collapsed position 34 in front of the bucket 16 as shown in FIG. 4. Additionally, both the left-hand version and the right-hand version of boom 10 above described have several intermediate positions 156 as shown in FIG. 2. Each of these positions 32, 34, 156 is held in place by plates. 96, 98 and pins 154. These positions 32, 156 allow for the boom to extend either generally parallel to the plane defined by the bucket side outwardly of the bucket or angularly with regard to that plane in front of the bucket. Each of these positions 34, 156 present the appliance attached to boom 10 in a different view from the tractor 12 allowing adjustability as desired in accordance with each application. In other embodiments, a variety of extended positions could also be provided for segment 74 extending from the plates 90, 92 between segments 72 and 74. By providing additional holes 94 and removing plates 98, 124, in still other embodiments, various extended positions can be provided for both segment 72 and segments 74, 76.

In still other specific embodiments, appliance cradle 22 may be of a variety of conventional structures. Both the brackets 142, 144 may vary depending upon the appliance and the cradle 22 itself may be of totally different structure. All conventional appliance cradles 22 by which a useful appliance can be secured to boom 10 are useful with the inventions herein disclosed and are intended to be within the scope hereof.

In still other embodiments, boom 10 can be constructed in a rigid and non-collapsible manner. In this version, both of the pivotal connections between segments 70, 72, 74, 76 are eliminated and the bottom beams 84, 112 and top beams 82, 1 10 are single rigid beams. In this version, boom 10 is not collapsible. It either extends outwardly of bucket 16 or is disconnected from bucket 16 and stored.

Another version of the boom 10 that is useful in some circumstances would have only the pivotal connection between segments 70, 72. Still another version of boom 10 would only have the pivotal connection between segments 72 and 74. Each of these versions has particular usefulness under certain circumstances, and would be less costly to build than the specific embodiment illustrated in FIGS. 1–4.

Figure 3:
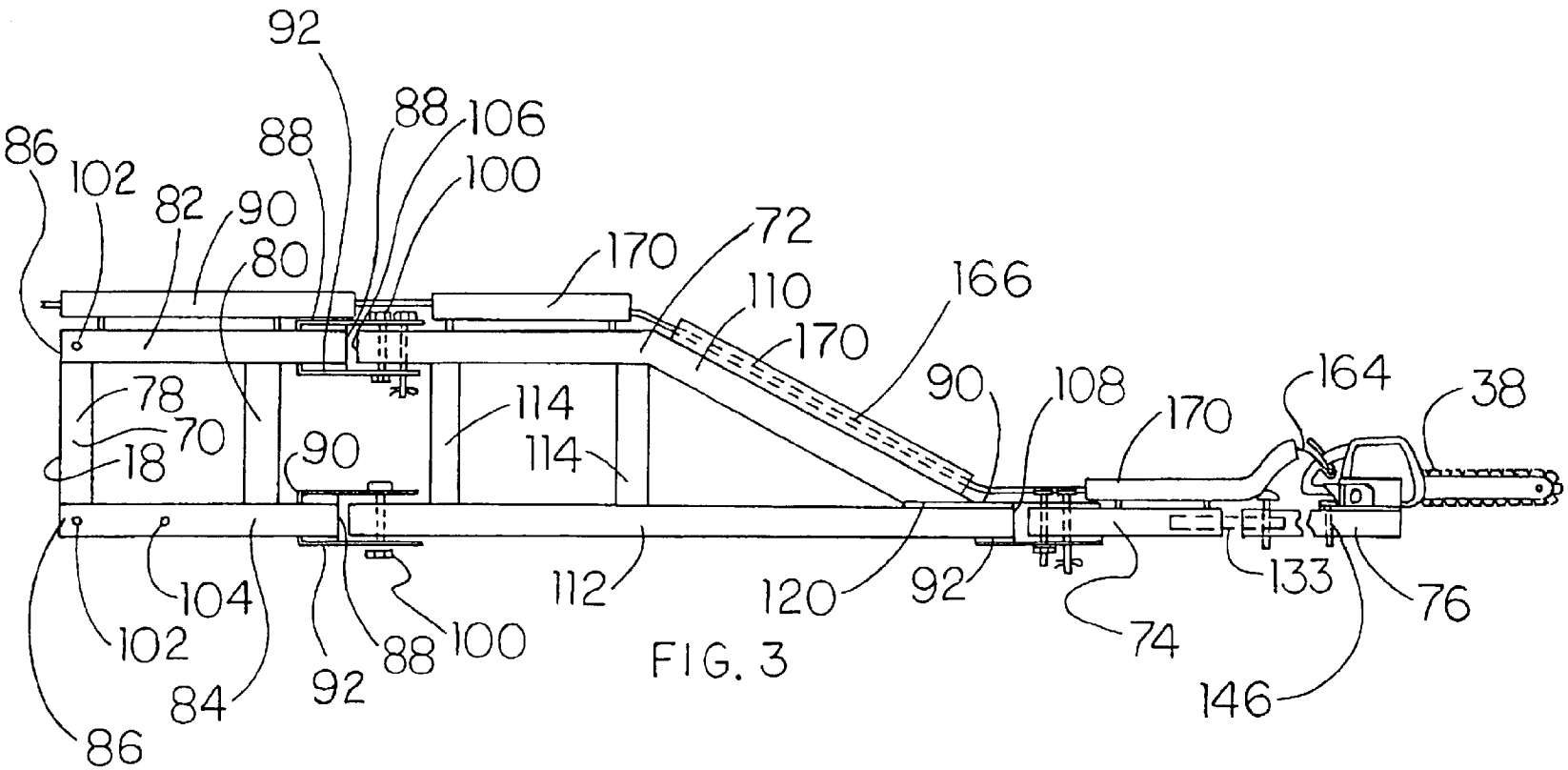
FIG. 3 is a side view of the appliance boom illustrated in FIGS. 1 and 2 in its extended position.

Secured to top beam 82, 110 and extending along boom 10, from end 18 to end 20 is a control cable pathway 166 defined either by a plurality of spaced apart eyelets 168 secured to beams 82 and 110 and segments 74, 76 as shown in FIG. 4, or by conduit segments 170 secured to beams 82, 110 and segments 74, 76 as shown in FIG. 3. Control cables 164 are threaded through the pathway 166 defined by eyelets 168 or conduits 170 and extend from the appliance secured to boom 10 in appliance cradle 22 to the controls A and B in the cab of the tractor 12. In a specific embodiment, the control cables 164 allow both the clutch and the throttle of the appliance to be actuated and controlled from the tractor 12. In other specific embodiments, the clutch is always actuated and only the throttle is controlled from the tractor 12. In the specific embodiment illustrated, the control cable 164 is attached to a pin 172 extending through the trigger on both sides of the handle to the appliance attached to the boom 10 by the appliance cradle 22. See FIG. 5.

In operation, boom 10 is secured to the bucket 16 by the boom mounting holes 160 in a side of the bucket 16. As shown in FIGS. 1 and 4, the boom 10 has boom mounting holes 102, 104 in top beam 82 and bottom beam 84 that correspond in size and spacing to the bucket mounting holes 160. By these holes, the boom 10 is secured to the bucket 16 so as to extend bottom member 84 of segment 70 outwardly of the bucket 16 generally parallel with the bottom of the bucket 16. Once secured to the bucket 16, boom 10 can then be lifted by moving the lift arms 40 of tractor 12 from its lower positions to its higher positions whereby the boom 10 is lifted with the bucket over and above the tractor 12. In specific embodiments, movement of the lift arms 40 of the tractor 12 will allow the appliance to be positioned over the tractor 12 in position B as shown in FIG. 1. In specific embodiments, this may position the appliance cradle 22 forty to sixty feet above the ground.

In addition to the movement of the boom 10 as the result of the movement of the lift arms 40, the boom 10 may move as a result of the change in position of the bucket 16 relative to the lift arms 40 by actuation of the power cylinder 64. In general, the bucket 16 is rotatable about its pivotal connection 44 to the lift arms 40 from a position (not shown) in which the opening of the bucket faces downwardly to a position B in which the opening of the bucket faces upwardly. In a specific embodiment, this rotation of the bucket 16 relative to the lift arms 40 of the tractor 12 is approximately 180 degrees. Thus, when the appliance being utilized is a chainsaw, as illustrated in FIGS. 1–4, the chainsaw may be brought in contact with a tree limb to be severed both by the movement of the lift arms 40 and by the rotation of the bucket 16 as desired.

The movement of the bucket 16 relative to the lift arms 40 and the movement of the lift arms 40 can both be controlled from within the tractor 12. By selectively adjusting the hydraulic fluid bypass on the tractor 12, the relative speed of the movement of the boom 10 by the movement of the lift arms 40 and the rotation of the bucket 16 can be selectively adjusted for the particular application. In the specific embodiment in which the appliance is a chainsaw, as illustrated in the drawings, the hydraulic bypass will need to be adjusted to appreciably slow down the movement of both the lift arms 40 and the bucket 16 from the top speed available when the bypass is fully closed.

In the embodiment of the boom 10 illustrated in the figures, the boom 10 can be selectively positioned in four positions 150, 152, 156 about the pivot 100 between segments 70 and 72 and in two positions between segments 72 and 74 as best shown in FIG. 2. As these positions are selected, pins 154 are removed from the openings 94 and the segments are positioned as desired and the pins replaced in the holes 94 to secure the segments in the desired position.

Similarly, once the appliance is secured to the appliance cradle 22, the appliance may be removed from the boom 10 simply and conveniently by removing the pin 154 connecting rod 130 to segment 76 at which time the appliance can be removed from the boom 10 by merely sliding the entire segment 76 with the saw attached from the rod 130. This would allow the appliance to be refueled or to have the oil changed without removal of the appliance from the appliance cradle 22.

Figure 5:
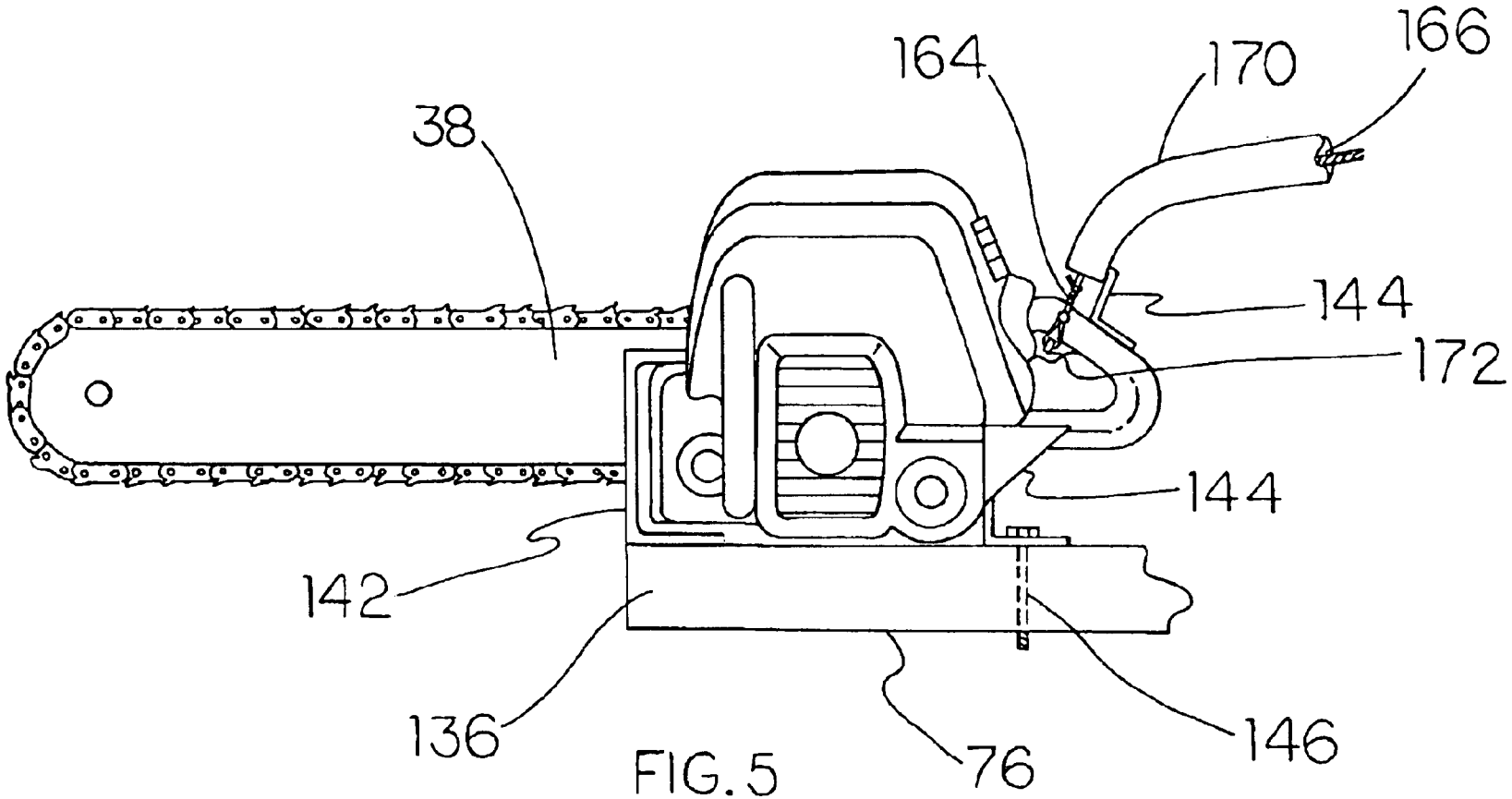
FIG. 5 is a fragmentary enlarged perspective view showing a chainsaw mounted to the appliance cradle of the invention.

As best shown in FIGS. 3 and 5, the appliance is secured to the appliance cradle 22 by loosening the movable bracket 144 and sliding the movable bracket 144 away from bracket 142. The appliance is then placed between the brackets 142, 144 and the bracket 144 is moved toward bracket 142 thereby grasping the appliance between the brackets 142, 144. In this position, movable bracket 144 is secured to the segment 76 and the appliance is rigidly secured to the appliance cradle 22. The control cables 164 are then secured to the throttle of the appliance. See FIG. 5. Similarly, the control cables 164 are secured to the control levers A and B in the cab such that movement of the control levers in the cab will actuate both the clutch and the throttle of the appliance by direct connection of the control cables properly trained through the passageway 166 defined by the eyelets 168 or the conduit segments 170 above described.

By the invention disclosed and claimed herein, the new and improved appliance boom that can be quickly attached and detached from a conventional tractor is provided. The new and improved appliance boom is specifically adapted to be secured to the bucket of a conventional bucket loader in a manner by which it can be mounted and dismounted and used conveniently. The new and improved appliance boom can carry a number of useful appliances at its distal end actuated from the tractor at elevations above the tractor and positions remote from the tractor in the same manner as is conventionally utilized. Appliances may range from chainsaws to reciprocating saws, drills or any rotary or reciprocating powered machinery. The new and improved appliance boom of the invention increases the versatility and usefulness of construction equipment such as bucket loaders in both the construction and farming industries and is relatively inexpensive to manufacture and is convenient to use and readily transported with the machinery over the road.

While the specific embodiment of the invention has been shown and described herein for purposes of illustration, the protection offered by any patent which may issue upon this application is not strictly limited to the disclosed embodiment; but rather extends to all structures and arrangements which fall fairly within the scope of the claims which are appended hereto.

What is claimed is:

1. An appliance boom having a plurality of structural members and opposite ends, one of said ends being adapted to be secured to the articulated powered appliance hitch of a conventional tractor, the other of said ends being secured to an appliance cradle, said boom having means for guiding control cables from end to end, and at least one control cable having opposite ends trained through said means, one of said control cable ends being adapted to be attached to the trigger of said appliance, the other of said control cable ends being adapted to be attached to a control lever in the cab of the tractor to which said boom is attached whereby an appliance may be secured to said boom and elevated above said tractor and operated therefrom, said means for guiding control cables from end to end being chosen from the group of guides consisting of spaced apart aligned eyelets, an elongated element having a passageway extending therethrough from end to end, a plurality of spaced apart segments of said elongated element and combinations thereof.

2. The boom of claim 1 wherein said one end is adapted to be secured to said tractor by providing a plurality of bolt holes extending through said structural members of said boom, said holes being sized and spaced to be matched up with bolt holes in one end of the bucket secured to the articulate powered appliance hitch of said tractor through which bolts may be positioned whereby said boom can be secured to said tractor to extend outwardly therefrom and be moved with said bucket.

3. The boom of claim 1 wherein said appliance cradle comprises a plurality of brackets secured to said structural members of said boom, said brackets grasping the housing of a gasoline powered appliance therebetween and securing said appliance to said boom.

4. The boom of claim 1 wherein said control cable is chosen from the group of filaments consisting of cords, cables, wires and other filaments of metal and naturally occurring and synthetic materials.

5. The boom of claim 1 wherein said structural members are secured in an end to end relationship to form a box frame.

6. The boom of claim 1 wherein said boom between said opposite ends measure approximately 15–60 feet.

7. The boom of claim 3 wherein said appliance cradle comprises a fixed bracket secured to the other of said boom ends, and a movable bracket which cooperates with said fixed bracket to grasp said appliance therebetween and that can be removably secured to said boom.

8. The boom of claim 1 wherein said one end is adapted to be secured to one end of a bucket of a conventional bucket loading tractor.

9. The boom of claim 1 wherein said appliance is a chain saw.

10. The boom of claim 1 wherein said boom is secured to the right-hand end of a bucket of a conventional front loading tractor, said boom extending from said tractor generally parallel to the plane of the open top of the bucket outwardly of said tractor, said boom being elevated over said cab from a generally horizontal position to a generally vertical position, said boom being articulated by the rotation of said bucket.

11. The boom of claim 1 wherein said one end is adapted to be secured to the left-hand end of a bucket of a conventional front loading tractor, said boom extending from said tractor generally parallel to the plane of the open top of the bucket outwardly of said tractor, said boom being elevated over said cab from a generally horizontal position to a generally vertical position, said boom being articulated by the rotation of said bucket.

12. The boom of claim 5 wherein said box frame is divided into a plurality of segments, said segments being pivotally connected together, said segments being moveable between a folded condition and an extended condition, said segments having means between said segments for locking said segments in said extended position and for locking said segments in said folded position.

13. The boom of claim 5 wherein said box frame is adjacent said one end of said boom.

14. The boom of claim 5 wherein said box frame is divided into two segments, namely, an end segment and a medial segment, said end segment and said medial segment being pivotally connected together.

15. The boom of claim 14 wherein said medial segment is positioned between said box frame at said one end of said boom and a tongue segment at the other end of said boom, said tongue segment having opposite ends, said medial segment and said tongue segment being pivotally connected together at one tongue end, the other tongue end being the distal end of said boom.

16. The boom of claim 15 wherein said appliance cradle is at said distal end of said tongue segment.

17. The boom of claim 12 wherein each of said means for locking comprises a top plate and a bottom plate secured to one of said segments, a pin extending through said plates about which the other of said segments is pivotally connected to said one segment, a pair of plates secured to said top and bottom plates on opposite sides of said top and bottom plates providing stops between which said one plate can pivotally move with respect to the other plate and a plurality of pin holes intermediate of said plates for receiving pins therein and holding said second segments in position.

18. The boom of claim 17 wherein said top and bottom plates of the pivotal connection between said one segment and said mediate segment has four pin holes between said plates thereby providing five distinct positions in which said mediate segment can be fixed with regard to said one segment.

19. The boom of claim 17 wherein said tongue is provided in two segments, one of said segments being pivotally connected to said mediate segment, the other of said segments being distal, said one and distal segments being removably connected together.

20. The boom of claim 19 wherein a tongue extends between said one and distal segments, said tongue being secured to one of said one and distal segments, said tongue being pivoted to the other of said one and distal segments.

21. The boom of claim 12 wherein one of the positions of each of said segments corresponds to said boom in said extendible position, another of said positions correspond to said boom in a collapsed position, the other positions being intermediate of said extendible position and said collapsed position.

22. An appliance boom having a plurality of structural members and opposite ends, one of said ends being adapted to be secured to the articulated powered appliance hitch of a conventional tractor, the other of said ends being secured to an appliance cradle, said boom having means for guiding control cables from end to end, and at least one control cable having opposite ends trained through said means, one of said control cable ends being adapted to be attached to the trigger of said appliance, the other of said control cable ends being adapted to be attached to a control lever in the cab of the tractor to which said boom is attached whereby an appliance may be secured to said boom and elevated above said tractor and operated therefrom, said one end being adapted to be secured to said tractor by providing a plurality of bolt holes extending through said structural members of said boom, said holes being sized and spaced to be matched up with bolt holes in one end of a bucket having spaced apart opposite ends and secured to the articulated powered appliance hitch of said tractor through which bolts may be positioned thereby to secure said boom to said tractor so as to extend outwardly therefrom and be moved with said bucket.

23. The boom of claim 22 wherein said boom extends from one end of said bucket outwardly of said bucket generally in the same plane as the bottom of said bucket.

24. An appliance boom having a plurality of structural members and opposite ends, one of said ends being adapted to be secured to the articulated powered appliance hitch of a conventional tractor, the other of said ends being secured to an appliance cradle, said boom having means for guiding control cables from end to end, and at least one control cable having opposite ends trained through said means, one of said control cable ends being adapted to be attached to the trigger of said appliance, the other of said control cable ends being adapted to be attached to a control lever in the cab of the tractor to which said boom is attached whereby an appliance may be secured to said boom and elevated above said tractor and operated therefrom, said one end being adapted to be secured to said tractor by providing a plurality of bolt holes extending through said structural members of said boom, said holes being sized and spaced to be matched up with bolt holes in one end of a bucket secured to the articulated powered appliance hitch of said tractor through which bolts may be positioned thereby to secure said boom to said tractor so as to extend outwardly therefrom and be moved with said bucket, said structural members being secured in an end to relationship to form a box frame, said box frame being divided into a plurality of segments, said segments being pivotally connected together, said segments being moveable between a folded condition in front of said bucket and an extended condition from one end of said bucket, said segments having means between said segments for locking said segments in said extended position and for locking said segments in said folded position.

* * * * *